US009478890B2

(12) United States Patent
Chonan et al.

(10) Patent No.: US 9,478,890 B2
(45) Date of Patent: Oct. 25, 2016

(54) CONNECTOR AND INSPECTION TOOL

(71) Applicant: Sumitomo Wiring Systems, Ltd., Yokkaichi, Mie (JP)

(72) Inventors: Takahisa Chonan, Mie (JP); Kazuo Nakai, Mie (JP)

(73) Assignee: SUMITOMO WIRING SYSTEMS, LTD., Yokkaichi (JP)

( * ) Notice: Subject to any disclaimer, the term of this patent is extended or adjusted under 35 U.S.C. 154(b) by 0 days.

(21) Appl. No.: 14/733,108

(22) Filed: Jun. 8, 2015

(65) Prior Publication Data

US 2015/0380853 A1 Dec. 31, 2015

(30) Foreign Application Priority Data

Jun. 27, 2014 (JP) ..... 2014-132084

(51) Int. Cl.
*H01R 13/514* (2006.01)
*H01R 13/422* (2006.01)
*H01R 43/20* (2006.01)

(52) U.S. Cl.
CPC ..... *H01R 13/4223* (2013.01); *H01R 43/20* (2013.01)

(58) Field of Classification Search
CPC ..... H01R 13/4223; H01R 13/4226; H01R 13/4362; H01R 13/422
USPC ..... 439/595, 752
See application file for complete search history.

(56) References Cited

U.S. PATENT DOCUMENTS 5,746,624 A * 5/1998 Ohsumi ..... H01R 13/6315 439/595
5,830,013 A * 11/1998 Saito ..... H01R 13/4362 439/595
6,062,906 A * 5/2000 Tanaka ..... H01R 13/4365 439/595
6,276,964 B1 * 8/2001 Shinozaki ..... H01R 13/424 439/595
6,302,735 B1 10/2001 Nishide et al.
7,670,177 B2 * 3/2010 Myer ..... H01R 13/4365 439/595
7,722,414 B2 * 5/2010 Tanaka ..... H01R 13/4365 439/595

* cited by examiner

*Primary Examiner* — Hae Moon Hyeon
(74) *Attorney, Agent, or Firm* — Gerald E. Hespos; Michael J. Porco; Matthew T. Hespos

(57) ABSTRACT

Locking lances (12) for retaining and locking terminal fittings (60) are deflectably provided at inner walls of cavities (11) of a housing (10). The housing (10) includes excessive deflection regulating pieces (13) each provided at a position facing the locking lance (12) in a deflecting direction of the locking lance (12) and configured to regulate excessive deflection of the locking lance (12). Locking lances (12) are provided side by side in a width direction perpendicular to an inserting direction of the terminal fittings (60). A plurality of the excessive deflection regulating pieces (13) are provided side by side in the width direction at positions corresponding to the locking lances (12) and have also a function of positioning an inspection tool (70) for inspecting an inserted state of the terminal fittings (60).

4 Claims, 5 Drawing Sheets

CONNECTOR AND INSPECTION TOOL

BACKGROUND

1. Field of the Invention

The invention relates to a connector and an inspection tool therefor.

2. Description of the Related Art

U.S. Pat. No. 6,302,735 discloses a connector with a housing that has cavities, and a deflectable locking lance projects forward at an inner wall of each cavity. A terminal fitting is inserted into each cavity from behind, and the properly inserted terminal fitting is retained and locked by the locking lance.

The cavities and the locking lances are provided side by side in a width direction that is perpendicular to an inserting direction of the terminal fittings into each cavity. A detection piece of a retainer is inserted into a deflection space for each locking lance in the housing and is provided with an excessive deflection regulating portion. If the terminal fitting is left incompletely inserted, a tip part of the locking lance contacts the excessive deflection preventing portion when the retainer is inserted. In this way, the locking lance is prevented from being deflected and deformed excessively.

A properly or improperly inserted state of the terminal fitting is inspected based on whether or not an inspection tool is insertable into the deflection space for the locking lance. Connectors continue to be miniaturized, and thus terminal fittings and an inspection tool also become smaller. Additionally, relative positions of the terminal fitting and the inspection tool easily are displaced from a proper position at the time of inspection. A displacement of the relative positions of the terminal fitting and the inspection tool from the proper position may adversely affect inspection reliability. A housing may have positioning portions for positioning the inspection tool, but this complicates the housing.

The invention was completed based on the above situation and aims to enhance reliability in inspecting an inserted state of terminal fittings while preventing the complication of the housing.

SUMMARY OF THE INVENTION

The invention relates to a connector that includes a housing with cavities into which terminal fittings are inserted. Deflectable locking lances are provided at inner walls of the cavities and are configured to retain and lock the terminal fittings. Excessive deflection regulating pieces are provided at positions facing the locking lances in deflecting directions of the respective locking lances and are configured to regulate excessive deflection of the locking lances. The locking lances are provided side by side in a width direction perpendicular to an inserting direction of the terminal fittings, and the excessive deflection regulating pieces are provided side by side in the width direction at positions corresponding to the locking lances and also function to position an inspection tool for inspecting an inserted state of the terminal fittings.

The inspection tool for inspecting the inserted state of the terminal fittings is positioned by the excessive deflection regulating pieces. Thus, the housing need not have dedicated positioning portions and the structure of the housing is not complicated. Particularly, since the excessive deflection regulating pieces are provided side by side in the width direction at the positions corresponding to the locking lances, a displacement of the inspection tool is suppressed and inspection reliability can be maintained high.

The excessive deflection regulating piece is provided for each of the locking lances juxtaposed in the width direction. Thus, the inspection tool is guided by each excessive deflection regulating piece during inspection to enhance positioning reliability.

The excessive deflection regulating pieces may be divided into plural sets. Each set may have plural mutually adjacent excessive deflection regulating pieces, and an interval between adjacent excessive deflection regulating pieces in each set is smaller than an interval between the excessive deflection regulating pieces mutually adjacent between adjacent sets. The inspection tool may have positioning holes into which the excessive deflection regulating pieces in the set are inserted. Thus, a large wall thickness corresponding to the interval between the excessive deflection regulating pieces mutually adjacent between the adjacent sets can be ensured for outer side walls of the inspection tool arranged at opposite widthwise sides of the positioning holes. As a result, the strength of the inspection tool can be improved and, consequently, it is possible to miniaturize the inspection tool.

The inspection tool for the connector configured as described above includes positioning holes into which the individual excessive deflection regulating pieces are inserted. Accordingly, an inspection tool with a predetermined strength can be ensured and it is possible to miniaturize.

DETAILED DESCRIPTION

Figure 2:
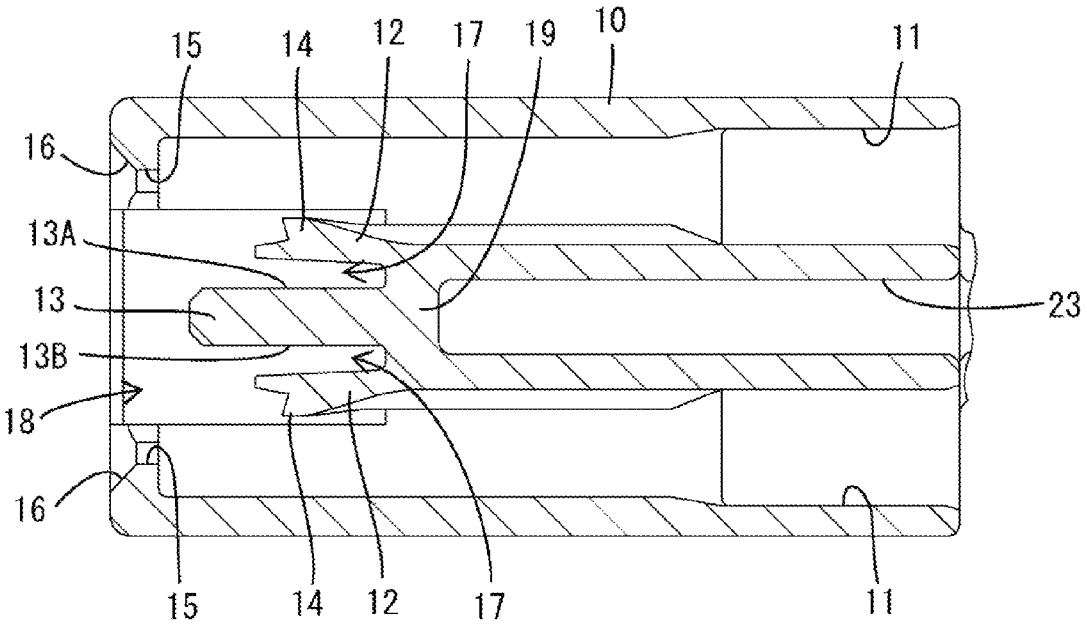
FIG. 2 is a side view in section of the housing.
Figure 3:
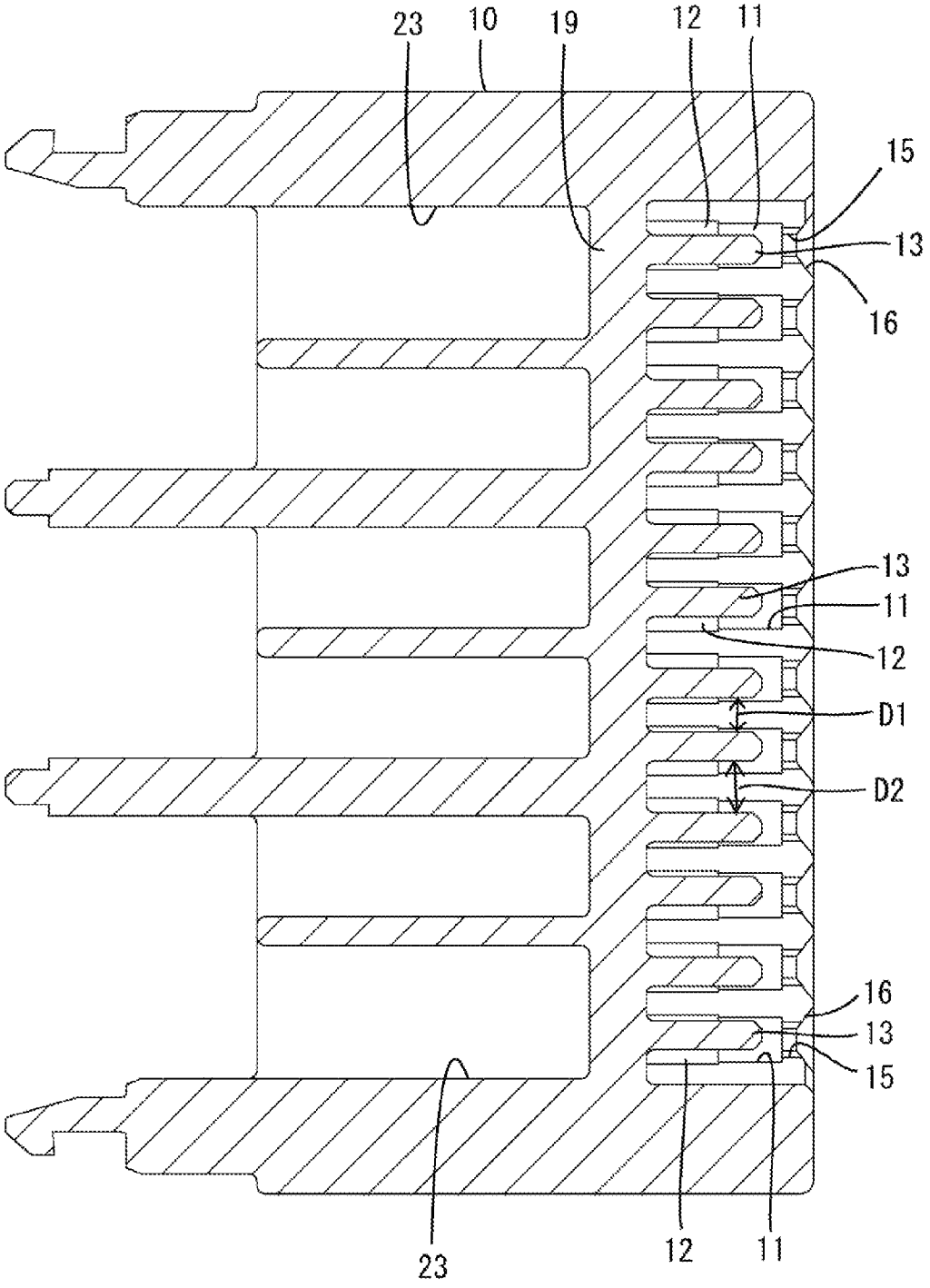
FIG. 3 is a plan view in section of the housing.
Figure 4:
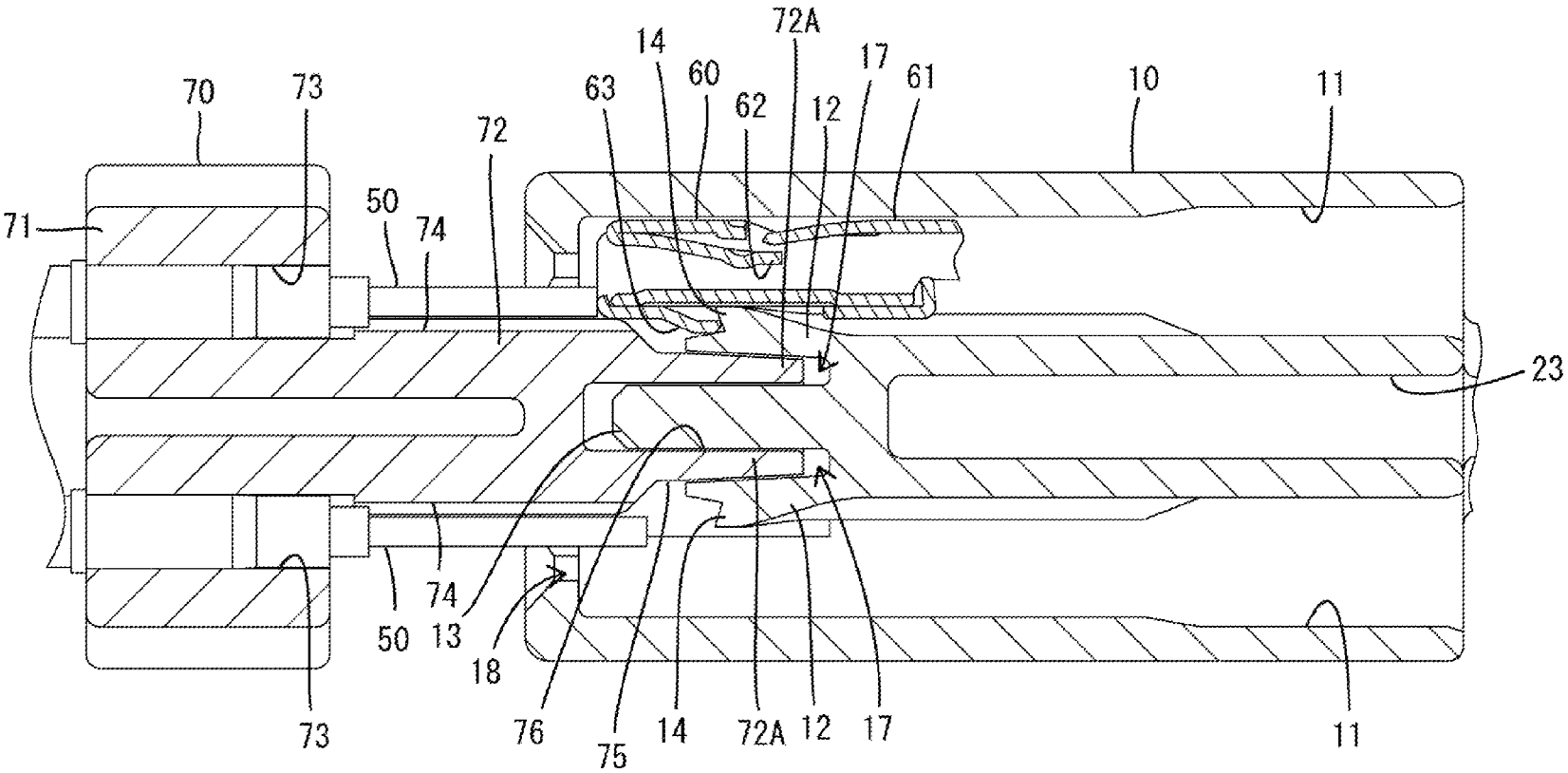
FIG. 4 is a side view in section showing a state where an excessive deflection regulating piece is positioned and inserted in a positioning hole for an inspection tool and an inserted state of a terminal fitting is inspected.

A connector according to an embodiment of the invention is illustrated in FIGS. 1-6 and includes a housing 10 that is made of synthetic resin and is connectable to an unillustrated mating housing. Terminal fittings 60 made of electrically conductive metal are to be mounted into the housing 10. An inspection tool 70 is mounted into the housing 10, as shown in FIG. 4, to determine whether or not an inserted state of the terminal fittings 60 is proper. In the following description, a front-back direction of the connector is defined so that a front of the terminal fittings 60 in an inserting direction into the housing 10 is a front end and a front-back direction of the inspection tool 70 is defined so that an end facing the front of the housing 10 at an initial position is a front end. Further, a vertical direction is based on each figure except FIG. 3. Furthermore, a width direction is a direction perpendicular to the front-back direction and the vertical direction and synonymous with a lateral direction of FIGS. 1 and 5.

Figure 1:
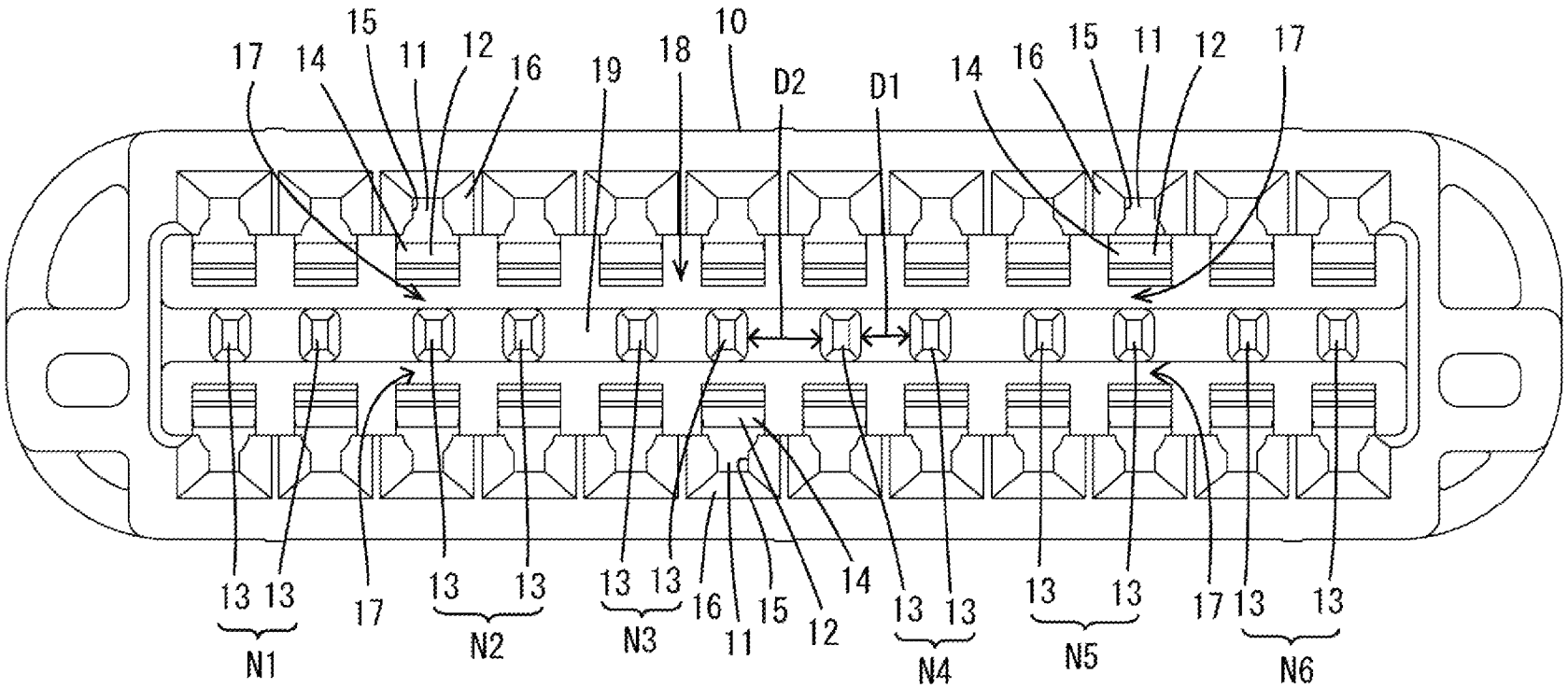
FIG. 1 is a front view of a housing of a connector according to an embodiment of the invention.

As shown in FIGS. 1 and 3, the housing 10 is long in the width direction and includes a plurality of cavities 11 extending in the front-back direction. As shown in FIG. 1, cavities 11 are arranged in the width direction in upper and lower stages.

As shown in FIGS. 1 and 2, a deflectable locking lance 12 is provided at an inner wall of each cavity 11. The respective locking lances 12 are provided separately at the lower surfaces of the inner walls of the cavities 11 in the upper stage and at the upper surfaces of the inner walls of the cavities 11 in the lower stage. Thus, the locking lances 12 in the upper and lower stages are in a back-to-back arrangement with excessive deflection regulating pieces 13 to be described later interposed therebetween. As shown in FIG. 2, the locking lance 12 is cantilevered forward. A locking projection 14 is formed on a front end part of the locking lance 12 to project into the cavity 11.

As shown in FIGS. 1 to 3, a tab insertion hole 15 is provided for each cavity 11 on a front wall of the housing 10 and communicates with the cavity 11. A tapered guide 16 is provided at a front end of each tab insertion hole 15 on the front surface of the housing 10 and is widened toward the front. As shown in FIG. 1, the tapered guide 16 in the upper stage is defined by an upper side part and opposite left and right side parts. The tapered guide 16 in the upper stage has no lower side part and the locking lance 12 in the upper stage is exposed on a front surface side of the housing 10 through an opening 18 corresponding to the lower side part so as to be visually confirmable. Further, the tapered guide 16 in the lower stage is defined by a lower side part and opposite left and right side parts. However, the tapered guide 16 in the lower stage has no upper side part and the locking lance 12 in the lower stage is exposed on the front surface side of the housing 10 through an opening 18 corresponding to the upper side part so as to be visually confirmable.

As shown in FIG. 4, the terminal fitting 60 is inserted into each cavity 11 of the housing 10 from behind. The terminal fitting 60 is connected to an end part of an unillustrated wire. A tubular box 61 is provided at a front part of the terminal fitting 60, and a resilient contact piece 62 is arranged deflectably in the box 61. Further, a locked portion 63 is formed by bending a cut part outward.

The box 61 interferes with the locking projection 14 in the process of inserting the terminal fitting 60 into the cavity 11 and the locking lance 12 is deflected and deformed into a deflection space 17. The locking lance 12 resiliently returns when the terminal fitting 60 is inserted properly into the cavity 11 and the locking projection 14 is locked to the locked portion 63. In this way, the terminal fitting 60 is held in the cavity 11 of the housing 10. Further, a male tab of an unillustrated mating terminal fitting is inserted through the tab insertion hole 15 and into the box 61 when the mating housing is connected and a tip of the male tab contacts the resilient contact piece 62 for electrically connecting the terminal fittings. In this case, the unillustrated male tab is guided by the tapered guide 16 and is inserted smoothly into the tab insertion hole 15.

As shown in FIGS. 1 and 2, a single wide opening 18 is provided substantially in a central part of the front wall of the housing 10 in the vertical direction and communicates with each cavity 11 in the upper and lower stages. The opening 18 is formed as an unillustrated mold is pulled forward in molding each locking lance 12 and each excessive deflection regulating piece 13.

As shown in FIG. 1, excessive deflection regulating pieces 13 are provided in a substantially central part of a back wall 19 of the opening 18 in the vertical direction. As shown in FIGS. 1 to 3, each excessive deflection regulating piece 13 is a substantially rectangular rib projecting forward from the back wall 19 and into the opening 18. As shown in FIG. 1, the excessive deflection regulating pieces 13 are arranged side by side in the width direction at positions corresponding to the respective locking lances 12 juxtaposed in the width direction. As shown in FIG. 2, the deflection spaces 17 for the locking lances 12 are open forward between an upper surface 13A of the excessive deflection regulating piece 13 and the locking lance 12 in the upper stage and between a lower surface 13B of the excessive deflection regulating piece 13 and the locking lances 12 in the lower stage. Specifically, the upper surface 13A of each excessive deflection regulating piece 13 faces the locking lance 12 in the upper stage from below (deflecting direction of the locking lance 12 in the upper stage) and contacts the locking lance 12 in the upper stage to prevent this locking lance 12 from being deflected and deformed beyond a normal deflection amount. Similarly, the lower surface 13B of each excessive deflection regulating piece 13 faces the locking lance 12 in the lower stage from above (deflecting direction of the locking lance 12 in the lower stage) and contacts the locking lance 12 in the lower stage to prevent this locking lance 12 from being deflected and deformed beyond the normal deflection amount. Thus, the excessive deflection regulating piece 13 prevents the upper and lower locking lances 12 from being deflected and deformed excessively beyond the normal deflection amount.

The excessive deflection regulating pieces 13 are arranged so that mutually adjacent two are formed into one set (N1, N2, N3, . . . in FIG. 1) and the respective sets are arranged in the width direction. Specifically, a widthwise interval D1 between the excessive deflection regulating pieces 13 adjacent in each set is set shorter than a widthwise interval D2 between the excessive deflection regulating pieces 13 adjacent between adjacent sets so that a relationship of D1<D2 holds. Thus, as shown in FIGS. 1 and 2, widthwise centers of the excessive deflection regulating pieces 13 are arranged at positions deviated from widthwise centers of the corresponding locking lances 12. Note that, as shown in FIGS. 2 and 3, the housing 10 is provided with bored portions 23 extending in the front-back direction and open on the rear surface at positions opposite to the respective excessive deflection regulating pieces 13 across the back wall 19.

Figure 5:
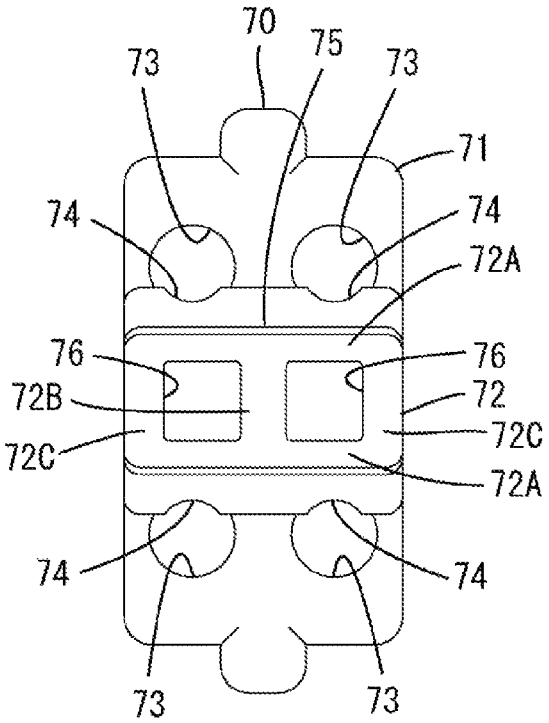
FIG. 5 is a front view of the inspection tool.
Figure 6:
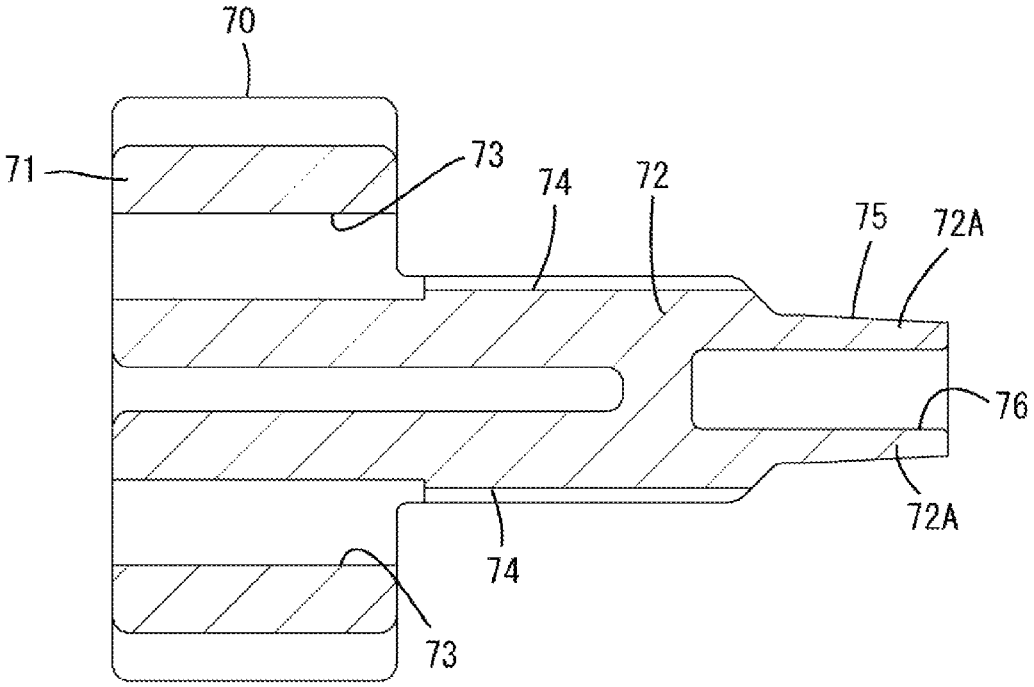
FIG. 6 is a side view in section of the inspection tool.

As shown in FIGS. 5 and 6, the inspection tool 70 has a main body 71 substantially in the form of a vertically long rectangular block and a detection piece 72 projects forward from the main body 71. Plural inspection tools 70 are combined in parallel in the width direction to define an unillustrated inspection device. The inspection tool 70 is movable in the front-back direction to an initial position at a distance from the front surface of the housing 10 and a detection position (see FIG. 4) where the inspection tool 70 approaches the front surface of the housing 10 to be mounted into the housing 10 by a moving mechanism provided in the inspection device.

As shown in FIGS. 5 and 6, detection holes 73 penetrate through the main body 71 in the front-back direction. Two detection holes 73 are provided at each of upper and lower sides of the detection piece 72, as shown in FIG. 5. As shown in FIG. 4, a probe pin 50 of the inspection device is inserted into each detection hole 73.

As shown in FIG. 5, the detection piece 72 is a plate rib coupled to a substantially central part of the main body 71 in the vertical direction over the entire width of the main body 71. Detection grooves 74 of arcuate cross-section are recessed on upper and lower surfaces of the detection piece 72 and coaxially communicating with the respective detection holes 73. As shown in FIG. 6, a front end part of the detection piece 72 defines a thinned portion 75 with a smaller vertical dimension than other parts.

As shown in FIG. 5, two positioning holes 76 are provided in the width direction on the front surface of the detection piece 72. The both positioning holes 76 are openings with a substantially rectangular shape in a front view. Further, as shown in FIG. 6, the positioning hole 76 extends in the front-back direction and has a closed rear end. The excessive deflection regulating pieces 13 in the set in the housing 10 are inserted into the positioning holes 76 in a positioned state (see FIG. 4).

As shown in FIG. 5, each of upper and lower walls 72A of the detection piece 72 between the upper surface of the thinned portion 75 and the inner upper surface of the positioning hole 76 and between the lower surface of the thinned portion 75 and the inner lower surface of the positioning hole 76 has a wall thickness corresponding to a vertical interval between the deflection spaces 17 (see FIG. 4). Further, an inner side wall 72B of the detection piece 72 arranged between the adjacent positioning holes 76 has a wall thickness corresponding to the widthwise interval D1 between the adjacent excessive deflection regulating pieces 13 in the set. Furthermore, each of outer side walls 72C of the detection piece 72 at opposite widthwise sides of the positioning holes 76 has a wall thickness corresponding to half the widthwise interval D2 between the adjacent excessive deflection regulating pieces 13 in adjacent sets. In this case, the wall thickness of the outer side walls 72C is substantially equal to that of the inner side wall 72B.

Next, an inspection method of the inspection tool 70 according to this embodiment is described.

The terminal fitting 60 is inserted into each cavity 11 of the housing 10 and then the connector is set in the inspection device. At this time, the inspection tool 70 is kept at the initial position and the probe pins 50 are inserted into the respective detection holes 73. The probe pins 50 are arranged along groove surfaces of the detection grooves 74 (see FIG. 4). Subsequently, the inspection tool 70 is moved from the initial position to the detection position.

If the inspection tool 70 is moved toward the detection position when the terminal fittings 60 inserted properly into the cavities 11, the detection piece 72 enters the opening 18 and the excessive deflection regulating pieces 13 in the set of the housing 10 are inserted into the positioning holes 76 of the inspection tool 70 in a fit state, thereby suppressing a displacement of a relative position of the inspection tool 70 with respect to the housing 10 from a proper position. Note that the inspection device has a number of inspection tools 70 corresponding to the number of the sets of the housing 10.

When the inspection tool 70 reaches the detection position as shown in FIG. 4, the tips of the probe pins 50 contact the front ends of the boxes 61 of the terminal fittings 60 so that an unillustrated detection circuit is closed. At this time, the excessive deflection regulating pieces 13 are inserted in the positioning holes 76 in the positioned state. Thus, the contact positions of the probe pins 50 with the terminal fittings 60 is not deviated significantly from predetermined positions. The probe pins 50 contact the terminal fittings 60 to close the detection circuit and to detect electrically that the terminal fittings 60 are inserted properly in the cavities 11.

On the other hand, the terminal fitting 60 may be left at an incompletely inserted position without being inserted to a proper position into the cavity 11. In this case, the locking projection 14 contacts the box 61 of the terminal fitting 60 located at the incompletely inserted position and the locking lance 12 is deflected and deformed into the deflection space 17. In such a state, the upper/lower wall 72A of the detection piece 72 interferes with the locking lance 12 and cannot be inserted to a proper depth into the deflection space 17 in the process of the inspection tool 70 moving toward the detection position. Thus, any further movement of the inspection tool 70 is stopped and the probe pins 50 do not reach the positions for contact with the terminal fittings 60. Thus, the detection circuit is not closed and it is known that the terminal fitting 60 is left at the incompletely inserted position.

As described above, the inspection tool 70 is positioned by the excessive deflection regulating pieces 13. Thus, it is not necessary to provide the housing 10 with dedicated positioning portions and the complication of the structure of the housing 10 can be prevented. More particularly, the excessive deflection regulating pieces 13 are provided side by side in the width direction at the positions corresponding to the locking lances 12. As a result, a displacement of the inspection tool 70 is suppressed and inspection reliability can be maintained high. In addition, the excessive deflection regulating piece 13 is provided for each of the locking lances 12 juxtaposed in the width direction. Therefore, the inspection tool 70 is guided properly by each excessive deflection regulating piece 13 at the time of inspection and positioning reliability is enhanced.

Further, the inspection tool 70 has the positioning holes 76 into which the excessive deflection regulating pieces 13 in the set are inserted. Thus, a large wall thickness corresponding to the interval D2 between the excessive deflection regulating pieces 13 adjacent between the adjacent sets can be ensured for the outer side walls 72C of the inspection tool 70 arranged at the opposite widthwise sides of the positioning holes 76. As a result, the strength of the inspection tool 70 can be improved, and the miniaturization of the inspection tool 70 can be achieved.

Excessive deflection of two locking lances adjacent in the width direction may be prevented by one excessive deflection regulating piece.

The excessive deflection regulating pieces may be arranged at equal intervals in the width direction in the housing.

The inspection tool may have one, three or more positioning holes.

Although the excessive deflection regulating piece is provided in common to the upper and lower locking lances in the case of the above embodiment, the excessive deflection regulating piece may be provided for each locking lance.

LIST OF REFERENCE SIGNS

10 . . . housing
11 . . . cavity
12 . . . locking lance
13 . . . excessive deflection regulating piece
17 . . . deflection space
60 . . . terminal fitting
70 . . . inspection tool
72 . . . detection piece
72C . . . outer side wall
76 . . . positioning hole
D1 . . . interval (interval between excessive deflection regulating pieces mutually adjacent in set)
D2 . . . interval (interval between excessive deflection regulating pieces mutually adjacent between adjacent sets)

What is claimed is:

1. A connector, comprising a housing including cavities, into which terminal fittings are inserted, deflectable locking lances provided at inner walls of the cavities and configured to retain and lock the terminal fittings, and excessive deflection regulating pieces each provided at a position facing the locking lance in a deflecting direction of the locking lance and configured to regulate excessive deflection of the locking lance, wherein:

a plurality of the locking lances are provided side by side in a width direction perpendicular to an inserting direction of the terminal fittings;

a plurality of the excessive deflection regulating pieces are provided side by side in the width direction at positions corresponding to the locking lances and are configured for positioning an inspection tool for inspecting an inserted state of the terminal fittings; and the inspection tool having positioning holes dimensioned and disposed so that each of the positioning holes can receive a respective one of the excessive deflection regulating pieces, the inspection tool further having detection holes disposed to align respectively with the cavities when the excessive deflection regulating pieces are inserted respectively into the positioning holes.

2. The connector of claim 1, wherein the terminal fittings are female terminal fittings.

3. The connector of claim 1 wherein the detection holes are provided in pairs with the detection holes in each of the pairs being aligned respectively on opposite sides of one of the positioning holes.

4. A connector, comprising:

a housing including cavities, into which terminal fittings are inserted, deflectable locking lances provided at inner walls of the cavities and configured to retain and lock the terminal fittings, and excessive deflection regulating pieces each provided at a position facing the locking lance in a deflecting direction of the locking lance and configured to regulate excessive deflection of the locking lance, wherein:

a plurality of the locking lances are provided side by side in a width direction perpendicular to an inserting direction of the terminal fittings; and a plurality of the excessive deflection regulating pieces are provided side by side in the width direction at positions corresponding to the locking lances and are configured for positioning an inspection tool for inspecting an inserted state of the terminal fittings, wherein the excessive deflection regulating pieces are divided into a plurality of sets, each set being composed of a plurality of mutually adjacent excessive deflection regulating pieces and an interval (D1) between the excessive deflection regulating pieces mutually adjacent in each set is smaller than an interval (D2) between the excessive deflection regulating pieces mutually adjacent between adjacent sets.

* * * * *